United States Patent [19]

Oesterling

[11] 4,321,050

[45] Mar. 23, 1982

[54] APPARATUS FOR SEVERING AND SHIFTING PLUGS FOR CIGARETTES OR THE LIKE

[75] Inventor: Erwin Oesterling, Hamburg, Fed. Rep. of Germany

[73] Assignee: Hauni-Werke Körber & Co. KG, Hamburg, Fed. Rep. of Germany

[21] Appl. No.: 41,316

[22] Filed: May 22, 1979

Related U.S. Application Data

[63] Continuation of Ser. No. 831,884, Sep. 9, 1977, abandoned.

[30] Foreign Application Priority Data

Sep. 9, 1976 [DE] Fed. Rep. of Germany ..... 2640567

[51] Int. Cl.[3] ..... A24C 5/50

[52] U.S. Cl. ..... 493/45; 83/107; 83/115; 83/152; 493/48; 493/343

[58] Field of Search ..... 493/343, 369, 370, 48, 493/45, 47; 83/152, 107, 115; 131/94

[56] References Cited

U.S. PATENT DOCUMENTS

| | | | |
|---|---|---|---|
| 3,039,367 | 6/1962 | Stelzer | 493/47 |
| 3,164,243 | 1/1965 | Rudszinat et al. | 198/32 |
| 3,199,418 | 8/1965 | Schubert | 83/107 X |
| 3,228,512 | 1/1966 | Rudszinat et al. | 198/30 |
| 3,238,825 | 3/1966 | Dearsley | 83/411 R |
| 3,245,414 | 4/1966 | Rudszinat | 131/94 |
| 3,487,754 | 1/1970 | Flasdieck | 493/46 X |
| 3,625,103 | 12/1971 | Giatti | 83/152 X |
| 3,712,162 | 1/1973 | Giatti | 83/102 |
| 3,948,084 | 4/1976 | Heitmann et al. | 73/41 |
| 3,957,152 | 5/1976 | Heitmann | 198/34 |
| 3,957,156 | 5/1976 | Schwenke | 198/235 |
| 3,961,633 | 6/1976 | Schubert et al. | 493/48 X |
| 3,962,957 | 6/1976 | Hinzmann | 131/17 R X |
| 4,003,277 | 1/1977 | Oesterling | 83/102 |
| 4,004,593 | 1/1977 | Kaeding et al. | 131/21 R |
| 4,020,751 | 5/1977 | Greve et al. | 493/47 |
| 4,044,659 | 8/1977 | Bardenhagen et al. | 198/343 X |

OTHER PUBLICATIONS

"Operating Instructions"-Max 15 (2nd Edition), Hauni--Werke Körber & Co., Hamburg, Germany.

*Primary Examiner*—James F. Coan
*Attorney, Agent, or Firm*—Kontler & Grimes

[57] ABSTRACT

Filter plugs of double unit length are fed sideways into successive flutes of a rotating drum which moves successive plugs past a rotary knife so that each plug yields two coaxial sections of unit length. Each flute contains two spaced apart mechanical stops at the opposite sides of the cutting plane and each flute has two suction ports which are overlapped by the corresponding stops. The ports draw streams of air which attract the respective sections immediately upon completion of the cutting step so that the sections move away from each other and against the respective stops. Plugs of a different second type are thereupon inserted into the gaps between successive coaxial sections. The cutting station is overlapped by a stationary shroud having an opening through which the knife extends with sufficient clearance to allow streams of atmospheric air to flow into that flute which is located at the cutting station and into the respective suction ports.

9 Claims, 2 Drawing Figures

SUCTION GENERATING MEANS

APPARATUS FOR SEVERING AND SHIFTING PLUGS FOR CIGARETTES OR THE LIKE

This is a continuation of applicaton Ser. No. 831,884, filed Sept. 9, 1977, and now abandoned.

BACKGROUND OF THE INVENTION

The present invention relates to apparatus for manipulating rod-shaped articles, especially articles which constitute or form part of rod-shaped smokers' products. More particularly, the invention relates to improvements in apparatus which can be used with advantage for severing and shuffling of two or more different types of rod-shaped filter material in order to form composite filter mouthpieces for cigarettes, cigars or cigarillos.

Composite filter mouthpieces are normally produced by moving two or more types of prefabricated filter rods sideways, severing the filter rods so that each thereof yields shorter rods, staggering and shuffling the shorter rods of each type, shuffling the different types of shorter rods to form a continuous rod wherein shorter rods of different types alternate with each other, draping the continuous rod into a web of artificial cork or other wrapping material, and subdividing the wrapped rod into discrete mouthpieces each of which contains rod-shaped sections consisting of different filter materials, e.g., plugs consisting entirely of acetate fibers and plugs which contain acetate fibers and granulae of charcoal. The filter mouthpieces are thereupon assembled with plain cigarettes, cigars or cigarillos to form therewih filter-tipped smokers' products.

A drawback of presently known apparatus for the production of composite filter mouthpieces is that such apparatus comprise a large number of drums, knives, spreading cams and other components. This contributes to the bulk and cost of such apparatus. Moreover, mechanical shifting of relatively short filter rods presents many problems, especially at elevated speeds, and is likely to result in deformation of and/or other damage to the articles.

Commonly owned German Pat. No. 1,116,128, granted May 3, 1962, discloses an apparatus for severing filter rods by means of a rotary knife which is mounted between wedge-like flanges serving to increase the gap between the sections of the severed rod so as to provide room for insertion of rod-shaped filter plugs of a different type. The patent further mentions the possibility of using a wedge-like cam downstream of the cutting station and/or of employing nozzles for discharge of compressed air in order to increase the width of the gap between the sections of a severed filter rod beyond that width which is achieved by placing the knife between two wedge-like flanges. A drawback of the patented apparatus is that the circumferential portions of the flanges must be machined with an extremely high degree of accuracy. Moreover, the edges at the circumferences of the flanges are subjected to extensive wear, especially if the filter rods contain granulae of charcoal or other hard material, and the flanges invariably affect the appearance of the corresponding end faces of the filter rod sections. Furthermore, the aforementioned cams and nozzles must be provided in addition to the flanges, and the ultimate width of the gaps betwen the sections of successive pairs often deviates from an optimum width. Therefore, the patented apparatus failed to gain acceptance in the tobacco processing industry.

OBJECTS AND SUMMARY OF THE INVENTION

An object of the invention is to provide a simple, compact and inexpensive apparatus for manipulating rod-shaped articles, especially articles which are to form part of composite or multiplex filter mouthpieces for cigarettes or analogous rod-shaped smokers' products.

Another object of the invention is to provide a novel and improved apparatus for severing and shifting filter plugs or analogous rod-shaped articles.

A further object of the invention is to provide an apparatus of the just outlined character whose space requirements are a small fraction of space requirements of conventional apparatus, which comprises a surprisingly small number of simple parts, which can be installed in existing production lines for filter cigarettes or the like, and which can manipulate rod-shaped articles at a high frequency without any deformation of or other damage to the articles.

An ancillary object of the invention is to provide a machine which can be used for mass-production of multiplex filter mouthpiece and wherein the number of drums, cams and analogous parts is a relatively small fraction of the number of such parts in a conventional machine.

The invention is embodied in an apparatus for manipulating rod-shaped articles, particularly for assembling composite filter plugs which are used in filter cigarette making and analogous machines. The apparatus comprises a conveyor (e.g., a rotary drum) having a plurality of article receiving means each of which may constitute an elongated flute machined into the peripheral surface of the drum and parallel to the drum axis, a pair of spaced apart mechanical stops in each receiving means, a shaft or other suitable means for advancing the receiving means along an endless path, a second conveyor or other suitable means for feeding rod-shaped articles into the receiving means and preferably midway between the stops of the respective pair of stops in a first portion of the endless path, a rotary disc-shaped knife or other suitable means for severing successive articles in a second portion of the endless path so that each severed article yields two substantially coaxial rod-shaped sections, preferably two sections of identical length, and means for moving the sections of successive severed articles apart and into abutment with the respective stops immediately upon completed severing of the respective articles.

In accordance with a feature of the invention, the moving means comprises means for establishing a pressure differential between the ends of rod-shaped sections with the lower-pressure zones located at those ends of the sections which face the respective stops so as to induce axial movement of the sections against the respective stops. According to a presently preferred embodiment of the invention, the pressure differential establishing means comprises an arcuate shroud which overlies the flutes of the drum in the second portion of the path (the front and rear ends of the shroud preferably extend upstream and downstream of such second portion of the path) and suction ports provided in the innermost portions of the flutes in the region of the respective stops so that streams of air which flow in the flutes toward and into the suction ports induce axial movement of the sections against the corresponding stops.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figures 1, 2:
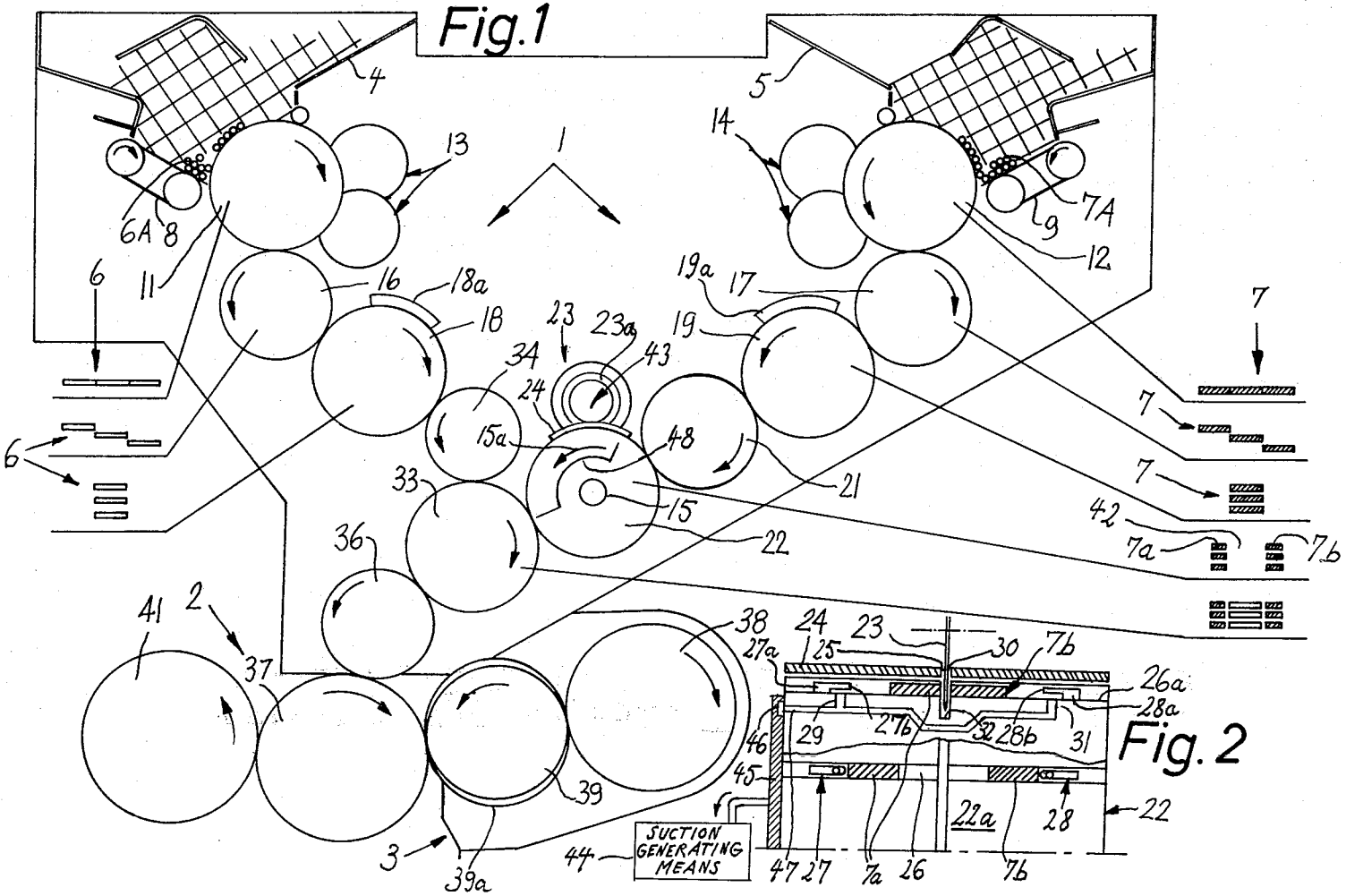
FIG. 1 is a fragmentary schematic front elevational view of a production line wherein plain cigarettes are assembled with composite filter mouthpieces and which includes an apparatus embodying the present invention.
FIG. 2 is an enlarged fragmentary partly plan and partly axial sectional view of the conveyor and certain other components of the improved apparatus.

FIG. 1 shows a portion of a production line for filter cigarettes. The production line comprises three units, namely, a first unit 1 which serves to produce composite or multiplex filter mouthpieces each of which consists of a tubular wrapper (not shown) a filter rod or plug 6 of a first type, and two filter plug sections *7a, 7b* of a second type. The sections *7a, 7b* flank the respective filter plug 6. Each mouthpiece is of double unit length and each such mouthpiece is assembled with two plain cigarettes of unit length to form therewith a filter cigarette of double unit length. Such cigarettes are thereupon severed midway between their ends (across the respective filter plugs 6) to yield pairs of filter cigarettes of unit length each of which contains a plain cigarette of unit length, a filter plug section *7a* or *7b* and one-half of a filter plug 6. The assembling of filter mouthpieces with plain cigarettes takes place in the second unit 2 of the production line; such second unit may constitute a filter tipping machine of the type known as MAX or MAX S (trademark), both produced by Hauni-Werke Körber & Co., KG, of Hamburg, Federal Republic Germany. The third unit 3 of the production line is a cigarette maker, e.g., a machine known as GARANT (trademark) produced by Hauni-Werke.

The apparatus which embodies the present invention forms part of the unit 1 which comprises two magazines 4, 5 respectively containing supplies of parallel filter rods 6A and 7A of six times unit length. The outlets of the magazines 4, 5 are respectively located above rotary drum-shaped severing conveyors 11, 12 having peripheral flutes which respectively receive rods 6A, 7A. The admission of rods 6A, 7A into the flutes of the respective severing conveyors 11, 12 is enhanced by endless belts 8, 9 whose upper reaches move in the directions indicated by arrows on the associated pulleys to promote the movement of rods 6A, 7A into the flutes travelling below the respective outlets. The severing conveyors 11, 12 respectively cooperate with pairs of rotary disk-shaped knives 13, 14 which sever successive rods 6A, 7A so that these rods respectively yield groups of three coaxial filter plugs or rods (rod-shaped articles) 6, 7 of double unit length.

Successive groups of filter plugs or rods 6 are transferred into the peripheral flutes of three rotary drum-shaped staggering conveyors 16 (only one shown) which are rotated at different speeds and/or transport the respective rods 6 through different distances so that the previously coaxial rods are staggered, as considered in the circumferential direction of the illustrated conveyor 16, prior to transfer into successive flutes of a rotary drum-shaped shuffling conveyor 18. The latter cooperates wih stationary cams 18*a* to shift some or all of the rods 6 axially so that the rods form a single row wherein each preceding rod is in exact register with the next-following rod. The rods 6 of the thus obtained row are transferred into successive flutes of an inserting or transfer conveyor 34 which admits successive rods 6 into successive flutes of a rotary drum-shaped assembly conveyor 33. The rods 6 in the flutes of the assembly conveyor 33 are located substantially midway between the axial ends of this conveyor.

As mentioned above, the severing conveyor 12 cooperates with two rotary disk-shaped knives 14 which subdivide each rod 7A into three coaxial rods 7 of double unit length. The rods 7 are thereupon staggered by conveyors 17 (only one shown), shuffled by a conveyor 19 which cooperates with cams 19*a*, and delivered into successive flutes of a rotary drum-shaped feeding conveyor 21.

The conveyor 21 can be said to form part of the improved apparatus which further comprises a rotary drum-shaped severing conveyor 22 having a cylindrical peripheral surface 22*a* provided with article-receiving flutes 26 (see FIG. 2) each of which is parallel to the axis of a shaft 15 serving as a means for advancing the flutes 26 sideways along an endless circular path in the direction indicated by arrow 15*a*. The conveyor 22 has a circumferential groove 32 which is disposed midway between the axial ends of this conveyor and intersects the flutes 26. The groove 32 receives the marginal portion of a rapidly rotating disc-shaped knife 23 which severs each rod 7 midway between its ends so that the rods 7 yield pairs of coaxial rod-shaped sections *7a* and *7b*.

The means for moving the sections *7a, 7b* apart immediately upon completion of the severing step and for insuring that the sections *7a, 7b* are separated from each other by a gap 42 of optimum width includes pairs of mechanical stops 27, 28 which are installed in the flutes 26 of the conveyor 22 in such a way that the stops 27 are adjacent to the left-hand axial end and the stops 28 are adjacent to the right-hand axial end of the conveyor 22, as viewed in FIG. 2. The just mentioned moving means further comprises an arrangement which establishes a pressure differential between the axial ends of each section *7a, 7b* so as to move the sections *7a* toward and against the respective stops 27 and to move the sections *7b* toward and against the respective stops 28. Such pressure differential establishing means includes an arcuate shroud 24 which overlies the flutes 26 at the severing or cutting station 43 and whose ends preferably extend upstream and downstream beyond the cutting station (see FIG. 1), and two suction ports 29, 31 in each flute 26. As shown in FIG. 2, the shroud 24 has an opening for the knife 23 and the width of the opening is such that the knife is received therein with sufficient play to provide two clearances 25 and 30. The clearances 25, 30 are disposed at the opposite sides of the plane of the knife 23 (such plane is normal to the axis of the shaft 15 and is located midway between the axial ends of the conveyor 22). The clearance 25 allows streams of atmospheric air to flow toward and into successive suction ports 29, and the clearance 30 allows streams of atmospheric air to flow toward and into successive suction ports 31. The shroud 24 may be made of sheet metal and is mounted close to the peripheral surface 22*a* of the conveyor 22 so as to enable the suction ports 29, 31 to reduce the pressure at the outer ends of the respective sections *7a, 7b,* i.e., at those ends which face the respective stops 27, 28.

The exact manner in which the suction ports 29, 31 are connected with the intake of a suitable suction generating device (e.g., a fan 44) forms no part of the invention. For example, one end face of the conveyor 22 can be placed adjacent a stationary valve plate 45 which has an arcuate groove 46 connected to the intake of the fan 44 and communicating with successive channels 47 which in turn communicate with the respective pairs of suction ports 29, 31. The groove 46 preferably extends along an arc 48 of approximately 150 degrees, beginning at the one o'clock position and ending at the eight o'clock position of the conveyor 22, as viewed in FIG. 1. This insures that the sections *7a, 7b* are moved against the respective stops 27, 28 as soon as they are completely separated from each other and that the sections *7a, 7b* continue to abut against the corresponding stops during travel to a transfer station between the conveyor 22 and the assembly conveyor 33 which latter constitutes a means for removing sections *7a, 7b* from the flutes 26. The width of the gaps 42 between coaxial sections *7a, 7b* suffices to provide room for rods 6 so that each rod 6 which reaches the transfer station between the conveyors 22 and 33 constitutes with the respective sections *7a, 7b* a composite (three-piece) filler of a filter plug of double unit length. Such fillers are delivered into successive flutes of a rotary drum-shaped transfer conveyor 36 which admits such fillers into successive flutes of a second rotary drum-shaped assembly conveyor 37 forming part of the unit 2. The conveyor 37 further receives parts of plain cigarettes of unit length from the unit 3. The latter comprises a rotary drum-shaped row forming conveyor 38 which has peripheral flutes for discrete plain cigarettes of unit length. The cigarettes in the first, third, etc. flutes are nearer to one axial end, and the cigarettes in the second, fourth, etc. flutes are nearer to the other axial end of the conveyor 38. Thus, such cigarettes form two rows, and the cigarettes of one row are staggered with respect to the cigarettes of the other row, as considered in the circumferential direction of the conveyor 38. The cigarettes of one row are transferred into successive flutes of a first aligning conveyor 39, and the cigarettes of the other row are transferred into successive flutes of a second aligning conveyor 39*a*. The conveyors 39, 39*a* are driven at different speeds and/or transport the respective cigarettes through different distances so that each cigarette on the conveyor 39 is in axial alignment with a cigarette on the conveyor 39*a* when such cigarettes reach the transfer station between the conveyors 39, 39*a* on the one hand and the conveyor 37 on the other hand. The pairs of coaxial plain cigarettes are admitted into successive flutes of the assembly conveyor 37 in such a way that they flank the respective fillers (each consisting of a rod 6 flanked by two sections *7a, 7b*). The resulting groups of five coaxial rod-shaped articles each are thereupon transferred into successive flutes of an accelerating conveyor 41 in the unit 2. As mentioned above, the unit 2 converts successive groups into filter cigarettes of double unit length which are thereupon converted into pairs of coaxial filter cigarettes of unit length. Such pairs are converted into a single row which is caused to pass through one or more testing stations prior to admission into storage, into trays, or directly into the magazine of a packing machine, not shown.

Referring again to FIG. 2, it will be noted that each of the stops 27, 28 comprises an outer portion 27*a*, 28*a* which is affixed (e.g., bolted or glued) to the deepmost or innermost portion 26*a* of the respective flute 26 and an inner portion 27*b*, 28*b* which is spaced apart from the deepmost portion 26*a* and is parallel to the axis of the conveyor 22. The inner portions 27*b*, 28*b* overlies the respective suction ports 29, 31 to thus insure that these ports cannot be sealed by the sections *7a, 7b* during the last stage of movement toward the stops as well as to insure that the ports can attract the sections *7a, 7b* against the respective stops (inner portions 27*b*, 28*b*) during travel of such sections from the cutting station 43 and all the way to the transfer station between the conveyors 22 and 32. It is preferred to select the position of the groove 46 in such a way that the ports 29, 31 begin to communicate with the intake of the fan 44 even before the rod 7 at the station 43 is severed all the way, i.e., the ports 29, 31 reduce the pressure at the respective ends of the rod 7 even before the latter yields two discrete sections. This insures that the sections *7a, 7b* are invariably moved into and remain in contact with the respective stops 27, 28 prior to transfer into the flutes of the assembly conveyor 33.

If desired, one or both sides of the knife 23 may be provided with ring-shaped beads 23*a* (one shown in FIG. 1) which promote the movement of sections *7a, 7b* away from each other immediately upon completed severing of the respective rod 7. Other types of mechanical spreading means can be used with equal advantage. Rapid separation of coaxial sections *7a, 7b,* immediately upon completion of severing of the respective rod 7, is desirable and advantageous because this enables atmospheric air which enters via clearances 25 and 30 to act against the inner end faces of the freshly severed sections *7a, 7b* and to insure axial movement of such sections toward the respective stops. As a rule, the sections *7a, 7b* move abruptly against the respective stops as soon as the severing step is completed. Rebounding of sections on impact against the stop portions 27*b*, 28*b* is unlikely because the ports 29, 31 preferably continue to draw air even after the sections *7a, 7b* are fully separated from each other and after such sections reach the respective stops.

It is further within the purview of the invention to replace the suction ports with orifices (not shown) which are provided in the shroud 24 and admit compressed air in directions to move the sections *7a, 7b* toward the respective stops 27, 28. Such orifices can be provided in addition to the suction ports. However, it has been found that the ports 29, 31 are amply sufficient to insure reliable separation of sections *7a, 7b* in the respective flutes 26 before the sections are removed by the assembly conveyor 33.

The advantages of the improved apparatus will be readily appreciated. Thus, the apparatus renders it possible to reduce the space requirements of the production line because the shifting of sections *7a, 7b* axially and away from each other (to provide room for the rods 6) takes place on that conveyor (22) which cooperates with the knife 23 to form the sections *7a* and *7b*. Therefore, the assembly conveyor 33 can be mounted immediately downstream of the severing conveyor 22. Furthermore, the improved apparatus insures that the filter rod sections *7a, 7b* are invariably moved to optimum positions with respect to each other (i.e., to positions at an optimum distance from each other) and that the sections remain in such optimum positions during transport into the flutes of the assembly conveyor 33. This, in turn, insures reproducible assembly of fillers on the conveyor 33 and reduces the number of rejects due to the presence of unsatisfactory filter mouthpieces.

It has been found that the incorporation of improved apparatus results in a pronounced reduction of the dimensions, especially height, of the unit 1.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the claims.

What is claimed is:

1. In an apparatus for manipulating rod-shaped articles, particularly in an apparatus for assembling composite filter plugs, the combination of a conveyor having a plurality of article receiving means and a pair of spaced apart stops for each receiving means; means for advancing said receiving means sideways along an endless path; means for feeding rod-shaped articles into said receiving means between the respective stops in a first portion of said path; means for severing successive articles in a second portion of said path so that each severed article yields two coaxial rod-shaped sections; and means for moving the sections of successive severed articles apart and into abutment with the respective stops immediately upon completed severing of the respective articles, including means for establishing a pressure differential between the ends of sections with the lower-pressure zone located at that end of each section which faces the respective stop so as to induce axial movement of said sections against the respective stops, said pressure differential establishing means comprising a shroud overlying the receiving means in said second portion of said path and suction ports provided in said receiving means in the region of said stops.

2. The combination of claim 1, wherein each of said articles has a predetermined length and said conveyor is a rotary drum having a peripheral surface, said receiving means including elongated flutes provided in said surface and being parallel to the axis of said drum, the stops of each of said pairs of stops being adjacent to the opposite axial ends of said drum and the distance between the stops of each of said pairs of stops greatly exceeding said predetermined length.

3. The combination of claim 1, wherein said severing means comprises a rotary knife disposed in a plane which is located substantially midway between the stops of said pairs of stops.

4. The combination of claim 1, wherein said conveyor includes a rotary drum having a peripheral surface and said receiving means are flutes provided in said surface and being parallel to the axis of said drum.

5. The combination of claim 1, wherein said shroud extends upstream as well as downstream of said second portion of said path.

6. The combination of claim 1, wherein said shroud has an opening for said severing means, said severing means extending through said opening with a clearance at each side thereof so that said ports can draw air into the respective receiving means by way of the corresponding clearances.

7. The combination of claim 1, wherein said receiving means are flutes each having an innermost portion and said stops include inner portions spaced apart from the innermost portions of the respective flutes, said ports being provided in said innermost portions and being overlapped by the inner portions of the respective stops.

8. The combination of claim 1, further comprising means for inseting rod-shaped articles of a different second type between successive pairs of spaced apart coaxial sections.

9. The combination of claim 2, wherein said severing means includes a rotary disc-shaped knife disposed in a plane located substantially midway between the axial ends and normal to the axis of said drum, and further comprising means for removing successive pairs of spaced apart coaxial sections from the respective flutes in a third portion of said path.

* * * * *